US005292061A

United States Patent [19]

Castagnoni

[11] Patent Number: 5,292,061

[45] Date of Patent: Mar. 8, 1994

[54] BOX WHICH CAN BE OPENED FOR THE REMOVAL OF A PORTION

[75] Inventor: Danielle Y. Castagnoni, Marseille, France

[73] Assignee: R C L, Marseille, France

[21] Appl. No.: 29,575

[22] Filed: Mar. 11, 1993

[30] Foreign Application Priority Data

Mar. 19, 1992 [FR] France ..... 92 03289

[51] Int. Cl.[5] ..... B65D 5/54

[52] U.S. Cl. ..... 229/217; 229/125.42; 229/229

[58] Field of Search ..... 229/215, 217, 218, 219, 229/229, 230, 232, 125.42

[56] References Cited

U.S. PATENT DOCUMENTS

| | | | |
|---|---|---|---|
| 358,671 | 3/1887 | Jaeger | 229/229 |
| 1,974,925 | 9/1934 | Marsh | 229/125.42 |
| 2,205,068 | 6/1940 | Potter | 229/125.42 |
| 2,364,364 | 12/1944 | Hultin | 229/218 |
| 2,789,747 | 4/1957 | Graybill | 229/125.42 |
| 2,946,496 | 7/1960 | Stagmeier . | |
| 3,064,873 | 11/1962 | Robinson et al. | 229/125.42 |
| 3,071,304 | 1/1963 | Brastad | 229/229 |
| 3,096,921 | 7/1963 | Graybill | 229/232 |
| 3,126,141 | 3/1964 | Walter | 229/230 |
| 3,207,413 | 9/1965 | Ficaro | 229/125.42 |
| 3,580,482 | 5/1971 | Witte | 229/232 |
| 3,741,463 | 6/1973 | Young et al. . | |
| 4,032,061 | 6/1977 | Dutcher et al. | 229/230 |
| 4,122,948 | 10/1978 | Grieve et al. . | |
| 4,944,406 | 7/1990 | Zehnal | 229/229 |

FOREIGN PATENT DOCUMENTS

| | | | |
|---|---|---|---|
| 611116 | 12/1960 | Canada | 229/232 |
| 103603 | 4/1966 | Denmark | 229/232 |
| 2124285 | 12/1971 | Fed. Rep. of Germany | 229/215 |
| 309382 | 3/1969 | Sweden | 229/125.42 |

*Primary Examiner*—Gary E. Elkins
*Attorney, Agent, or Firm*—Cushman, Darby & Cushman

[57] ABSTRACT

A box having an end face provided with a closeable opening and a closing flap which can be tucked underneath a portion of the end face to secure the contents in the box by the provision of an inclined side edge extending from one side to the opposite side of the end face.

4 Claims, 1 Drawing Sheet

BOX WHICH CAN BE OPENED FOR THE REMOVAL OF A PORTION

FIELD OF THE INVENTION

The present invention relates to boxes, and more particularly those adapted to contain a batch of identical oblong, more particularly cylindrical, products slightly shorter than the box, such as spaghetti, a portion of which consists of a number of these products. A batch corresponds to several portions.

Spaghetti is sold to consumers in a parallelepipedonal cardboard box, one of the end faces of which consists of a flap. The spaghetti can be taken out by opening the flap and tipping the box upside down. In order to take out only some, part of the opening has to be covered. This operation requires a separate shutter member with a calibrated hole or, if done by hand, it is imprecise.

DESCRIPTION OF THE PRIOR ART

U.S. Pat. No. 3,741,463 describes a cardboard box having an opening flap adapted to be detached from the rest of the box when it is opened in order to operate a tear mechanism. The box cannot be resealed after some of its contents have been taken out.

U.S. Pat. No. 2,946,496 does indeed describe a box which is adapted to be re-closed, after a portion has been removed, by the insertion of a tab in a slot. This operation of inserting a tab, which is necessarily small and notched at its base to aid folding, is too intricate an operation for the ordinary, inexperienced consumer. The perforation of a slot in the blank from which the box is made requires an additional operation, of a different kind from the other operations of folding and glueing, and therefore needs a special apparatus to produce the box.

SUMMARY OF THE INVENTION

The invention remedies these disadvantages by means of a box which is easier to manufacture and which can be resealed more easily.

The parallelepipedonal box for oblong products of The parallelepipedonal box contains oblong products with the same cross-section. The box has an edge and an opposing edge as well as an end face which extends in a plane and in which is provided an opening. The opening has a first side extending along the edge and a second side. The box comprises an opening flap extending from the edge and having a free edge portion. The flap is normally folded back towards the opposing edge thereby closing the opening according to the invention, the box comprises a panel constituting part of the end face but further inside the box than the flap, and defining the second side of the opening and the opening flap is such that it can be curved in order to distance it from the free edge portion of a second side of the opening, and then be brought back, substantially parallel to the plane of the end face, into the normal folded position, in which it is slid behind the panel.

In order to aid the curving of the opening flap and the sliding thereof behind or under the panel, the first and second sides are adjacent to a similar third side which is shorter than them. The opening flap is thus made freer in its movements, the second side being inclined at an angle of less than 45° relative to the first.

In order to ensure the re-closing of the box still further, a secondary panel is provided which is further inside the box than the inner panel but, like said inner panel, is substantially in the plane of the end face, defining a fourth side of the opening adjacent to the first side.

If one end of the first side is at one of the corner of the box, the movement of re-closing the opening flap is made easier.

According to a particularly preferred embodiment, the opening flap is part of an upper flap applied to the inner panel and can be separated therefrom along a frangible tear line. This tear line serves as proof that the box has not been tampered with.

BRIEF DESCRIPTION OF THE DRAWINGS

In the accompanying drawings, which are given solely by way of example.

DETAILED DESCRIPTION OF THE INVENTION

Figure 1:
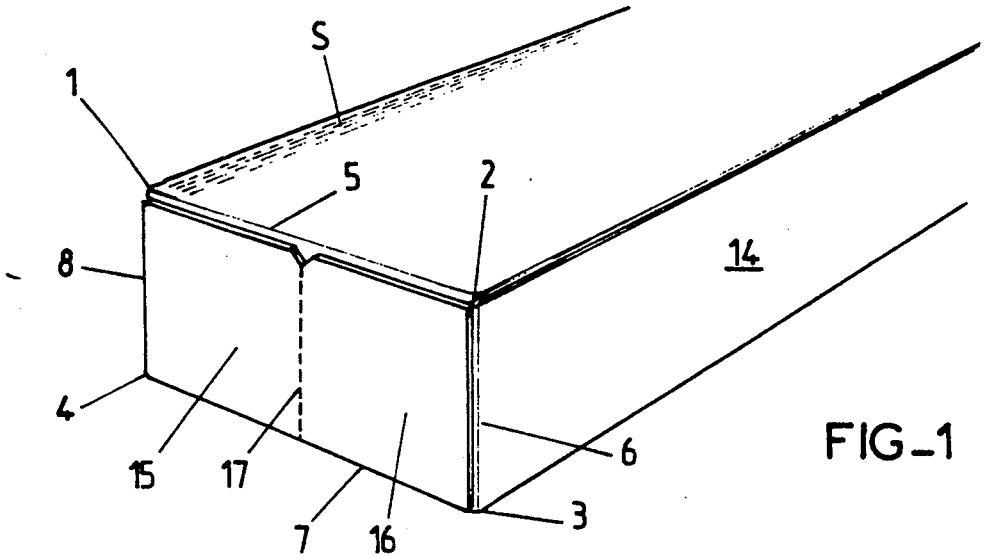
FIGS. 1, 2 and 3 are partial perspective views of a box of spaghetti, according to the invention, in the closed position, in the open position for removal and in the intermediate position, before re-closure.
Figure 2:
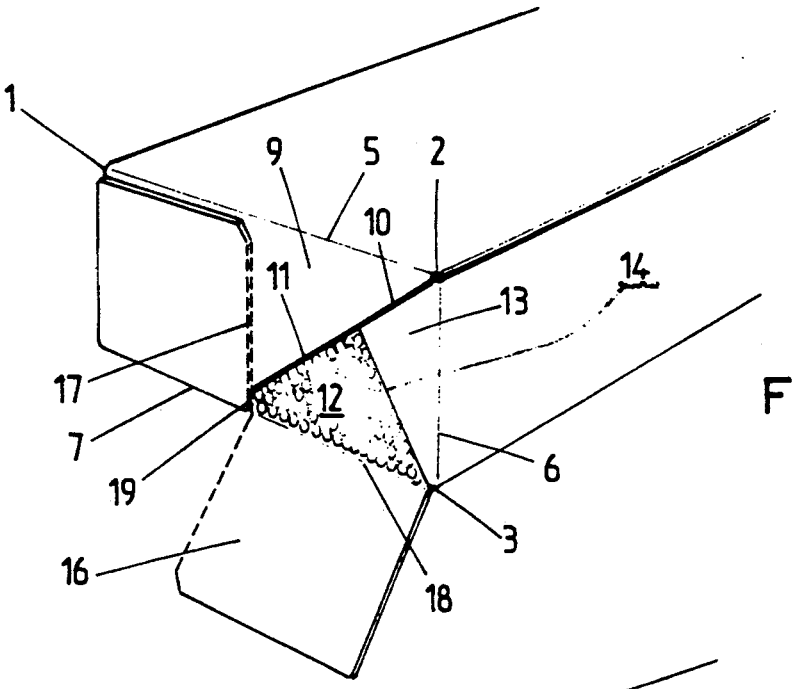
Figure 3:
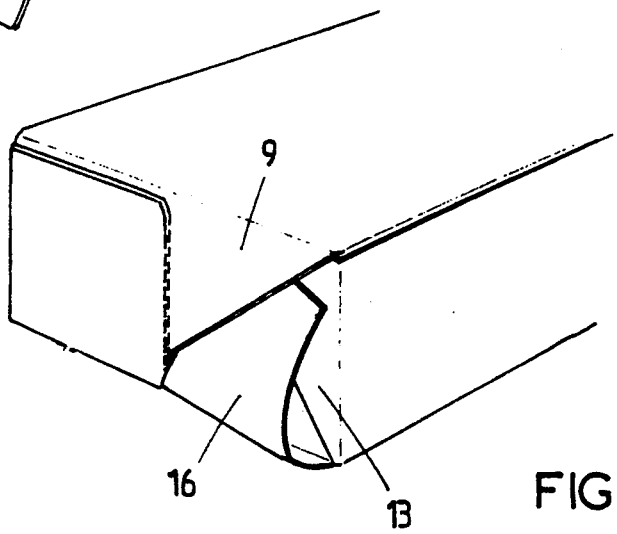

The box of spaghetti shown in FIG. 1 is produced from a folded cardboard blank and contains cylindrical spaghetti S. All the spaghettis have the same section. of identical cross-section. One of the end faces has four corners 1, 2, 3, 4 and four edges 5, 6, 7 and 8. It consists of an inner panel 9 which is folded about the edge 5 and extends up to the edge 7, along an edge portion 10 forming an angle of at least 45 with the edge portions 7 and defining a second side 11 of an opening 12, a secondary panel 13 folded about the edge 6, in the shape of a triangle one of the sides of which extends along the edge 5 and part of the hypotenuse 14 of which forms a fourth side of the opening 12, and a flap folded about the edge 7 and consisting of two parts 15, 16 separated from each other by a frangible tear line 17. The panel 13 is further inside the box than the panel 9, which is in turn further inside than the flap 15, 16, although the whole defines the end face and extends substantially in the same plane. The flap 15, 16 extends over the entire end face. After tearing along the line 17, the opening flap 16 is able to pivot about the part of the edge 7 which defines it and which constitutes the first side 18 of the opening 12. The constitutes the first side 18 of the opening 12. A new free edge of the flap which is formed after opening the flap is the edge portion opposite the edge 7 and is called here the free edge of the flap. A third side (9) of the opening 12 is the panel 9 intersects the edge 7 beyond the tear line 17.

In order to re-close the box after a portion has been taken out corresponding to the spaghetti visible in the opening 12, the flap 16 is bent so as to move it away from the free edge of the side 11 towards the edge 6, then it is brought parallel to itself and slid between the secondary panel 13 and the inner panel 9 below it.

I claim:

1. A parallelepiped shaped box including an end face having a first and a second edge, said second edge being opposite said first edge, said end face extending in a plane and including an opening having a first side which extends along said first edge and a second side which is inclined relative to said first side, a closing flap extending from said second edge and having a free end portion, said closing flap being movable from a folded position wherein said closing flap extends to said first edge and closes said opening, said end face including a panel including said second side of said opening, said panel being folded about said first edge and extending to said second edge and said closing flap being of a size such that said closing flap is insertable behind said panel to close said opening.

2. The box as claimed in claim 1, wherein said opening has a third side and said first and second sides thereof are adjacent to a third edge with said third side being shorter than said first side and shorter than said second side of said opening.

3. The box as claimed in claim 1, wherein a second panel is provided defining a fourth side of said opening in said end face adjacent to said first side.

4. The box as claimed in claim 1, wherein said first side of said opening has an end and said box having a corner with said end of said first side lying in said corner.

* * * * *